United States Patent [19]

Alston

[11] Patent Number: 4,664,499

[45] Date of Patent: May 12, 1987

[54] ELECTROSTATIC DUPLICATOR FOR MULTICOLOR IMAGERY

[75] Inventor: Julia M. Alston, Myrtle Bank, Australia

[73] Assignee: Coulter Systems Corporation, Bedford, Mass.

[21] Appl. No.: 700,087

[22] Filed: Feb. 11, 1985

[30] Foreign Application Priority Data

Feb. 14, 1984 [AU] Australia ..... PG3600

[51] Int. Cl.[4] ..... G03G 15/01; G03G 15/24

[52] U.S. Cl. ..... 355/4; 355/3 DR; 355/3 R

[58] Field of Search ..... 355/3 R, 3 DD, 4, 3 DR, 355/3

[56] References Cited

U.S. PATENT DOCUMENTS 3,795,917 3/1974 Yamaji et al. ..... 355/4

FOREIGN PATENT DOCUMENTS 901181 7/1962 United Kingdom ..... 355/3 R

*Primary Examiner*—Arthur T. Grimley
*Assistant Examiner*—David Warren
*Attorney, Agent, or Firm*—Silverman, Cass, Singer and Winburn, Ltd.

[57] ABSTRACT

An electrostatic duplicator for forming color composite images and employing preformed electrostatic masters (color separated fixed toner images). The duplicator has a drum including four flat sides for mounting respective ones of the masters (4). The respective functional stations (charging, toning, transfer and cleaning) are positioned about said drum adjacent the respective flat sides. The drum is stationary during performance of the functions and automatically rotatable by an angle of 90° in order to advance each of the electrostatic masters to the next station. Printing stock (to receive the transferred image) remains stationary until all of the component images of the composite image are received.

9 Claims, 1 Drawing Figure

ELECTROSTATIC DUPLICATOR FOR MULTICOLOR IMAGERY

BACKGROUND OF THE INVENTION

This invention relates to electrography and in particular relates to an electrostatic duplicator adapted to produce copies or prints of a subject matter in multiplicity of colors wherein all such colors are deposited on or transferred onto the copy in exact register relative to each other.

It is known to produce color prints by electrophotographic processes, such prints being commonly used as lithographic or gravure pre-press proofs. Such pre-press proofing processes are disclosed for instance in U.S. Pat. Nos. 3,337,340, 3,419,411 and 3,862,848. One such process, known as the Remak process, is described in addition in "The Printing Industry", by Victor Strauss, page 307, published 1967 by printing Industries of America Inc.

It is customary to produce such pre-press proofs by charging a photoconductive recording member followed by in register exposure through a separation transparency corresponding to one color, followed by toning of the exposed photoconductor with a liquid dispersed toner of the appropriate color, followed by in register transfer of the color toner image deposit to a receiving member surface, such as a printing stock.- These process steps are repeated with appropriate color separation transparencies and color toners to produce prints with two, three or four colors, as required. The printing stock is usually dried after each transfer operation to prevent back transfer of previously applied color deposits, but is normally rewetted with clean toner dispersant prior to each transfer operation.

In the known electrophotographic color proofing processes operating in automatic equipment the time required per color production on the printing stock is in the range 4 to 7 minutes, that is 16 to 28 minutes are needed to produce one 4-color proof. This is because for each color production the aforesaid steps of charging, exposure, toning, transfer, paper pre-wetting and drying have to be repeated.

In many instances as is well known in the art it is required to produce several pre-press color proofs of one and the same subject, most commonly up to 10 proofs in lithography and over 20 proofs in gravure printing. It is also customary to produce so called progressives, that is pre-press proofs of all single colors, two colors and three colors of one and the same subject. In such instances the presently known electrophotographic color proofing processes are found to be excessively time consuming, because to produce for instance 10 4-color proofs the time required is 2 hours and 40 minutes to 4 hours and 40 minutes. Thus there is need for a process whereby a multiplicity of color proofs of one and the same subject can be produced for economic reasons in considerably shorter time than presently possible.

As the time of 16 to 28 minutes required to produce one 4-color proof in presently known automatic equipment can not be readily shortened in view of the aforesaid process steps involved, it would be obvious to one skilled in the art to employ the method of electrostatic duplication for speeding up the process in all those instances where a multiplicity of 4-color proofs and/or progressives of one and the same subject is required.

Electrostatic duplication is well known wherein it is customary to employ an electrostatic master having a printing surface which comprises relatively conductive background or non-image areas and relatively insulative or dielectric image or printing areas corresponding to the information to be printed. The conductive or relatively conductive background area may be the surface of a metal plate or coated paper or a photoconductive recording member or the like whereas the image areas which will be referred to henceforth as primary image deposits can be formed by deposits of dielectric material. In the process of duplication such electrostatic master is usually placed over a conductive support member such as a rotating cylinder which is connected to the terminal of one polarity of a high tension DC power supply whereas the terminal of the other polarity of such power supply is connected to corona or electrostatic field generating means positioned near the printing surface of said electrostatic master to apply electrostatic charge to the primary image deposits contained thereon. Subsequently color toner material henceforth referred to as secondary toner, is applied to the printing surface. Such toner material is attracted to the charged primary image deposits and forms color toner deposits thereon which will be referred to henceforth as secondary image deposits. Such secondary image deposits are then transferred electrostatically or by other means onto a receiving member such as a sheet of paper on which such transferred secondary image deposits are subsequently affixed by heat fusion or other means. Subsequent copies are generated in like manner by preferably cleaning the electrostatic master, recharging the primary image deposits, forming secondary image deposits thereon and transferring the secondary image deposits to consecutive copy sheets.

It would be obvious to apply electrostatic duplication to the production of a multiplicity of proofs of one and the same subject by firstly preparing electrostatic masters representing each color separation and then employing such masters in an electrostatic duplicator sequentially with secondary toners of appropriate colors to produce at relatively fast rate a desired number of multicolor proofs.

The electrostatic masters can be prepared conveniently in an automatic electrophotographic equipment of the kind previously referred to by charging the photoconductor, exposure in register to the first color separation, toning the photoconductor with a dielectric primary toner, transferring in register the dielectric toner deposits onto a master base such as metal sheet or conductive coated paper and affixing the primary dielectric toner deposits thereto by air or heat or other means to form the electrostatic master for the first color. Electrostatic masters for the second and subsequent colors would be produced in the same manner by employing for in register exposure the second and subsequent color separations. The same dielectric toner would be used for all masters.

Color proofs could then be produced in an electrostatic duplicator of the type described in the foregoing by mounting the first color electrostatic master on the cylinder and preparing the required number of proofs on printing stock with the first color secondary toner, then replacing the electrostatic master with that for the second color whilst also replacing the printing stock already containing the first color image thereon and printing with the second color secondary toner. Subsequent colors would be printed in like manner by sequentially replacing the electrostatic masters for the following colors, replacing the printing stock and employing secondary toners of appropriate colors.

In an alternative method the electrostatic masters for all colors could be simultaneously mounted circumferentially on one and the same cylinder having fitted thereto suitably positioned or activated applicators for secondary toners of appropriate colors corresponding with the respective color electrostatic masters to be toned. The color proofs would then be produced by printing sequentially all colors onto the printing stock the required number of times.

Both above methods of duplication have certain disadvantages.

Firstly, the printing stock must be placed in very precise register preparatory to the transfer thereto of a secondary color toner deposit, then moved out of register for drying and replaced again in register for re-wetting and transfer thereto of subsequent secondary color toner deposits. It is very difficult to maintain good registration with printing stock paper particularly of the inexpensive publication type in view of the poor dimensional stability of such papers, which, in addition are to be wetted with a solvent, dried and again re-wetted several times.

Secondly, all functions such as charging the electrostatic master, toning with secondary color toners, transfer onto printing stock and cleaning of the master must be carried out at one and the same speed, which is the circumferential speed of the rotating cylinder. In practice it is found in many instances that for best proof quality it is necessary to carry out the said functions at different speeds.

Thirdly, all functions are performed sequentially with consecutive color electrostatic masters and thus no time can be saved by overlapping some or all of the functions, that is to say it is not possible to simultaneously process electrostatic masters for two or more colors, nor to start making the next proof before the preceding one is completed.

SUMMARY OF THE INVENTION

The general object of this invention is to provide an electrostatic duplicator wherein the above described disadvantages are eliminated. In brief, this is accomplished in accordance with this invention by providing in the electrostatic duplicator a square rather than a cylindrical carrier member having four flat sides for mounting thereon in register four electrostatic masters, each relating to one of the colors of a 4-color subject; the station for charging is positioned adjacent one of the flat sides of the carrier member, whereas the stations for toning, transfer and cleaning are positioned adjacent its second, third and fourth sides, respectively, whereby all such four functions can be performed simultaneously yet at different speeds; the carrier member is adapted to be stationary whilst such functions are being performed and upon completion of all functions to automatically rotate by an angle of 90° in order to advance each of the four electrostatic masters to the next functional station; the printing stock remains in register in the transfer station until all colors have been transferred thereto, after which it is replaced by new printing stock for the production of the next proof. Such operation consisting in automatic advancement of the electrostatic masters upon completion of functions continues until the required number of proofs is produced. The electrostatic duplicator of this invention is particularly suitable for the production of multiple proofs because in such case considerable time is saved by the last two functions required to complete one proof overlapping with or being carried out simultaneously with the first two functions required for the next proof.

DESCRIPTION OF THE PREFERRED EMBODIMENT

Figure 1:
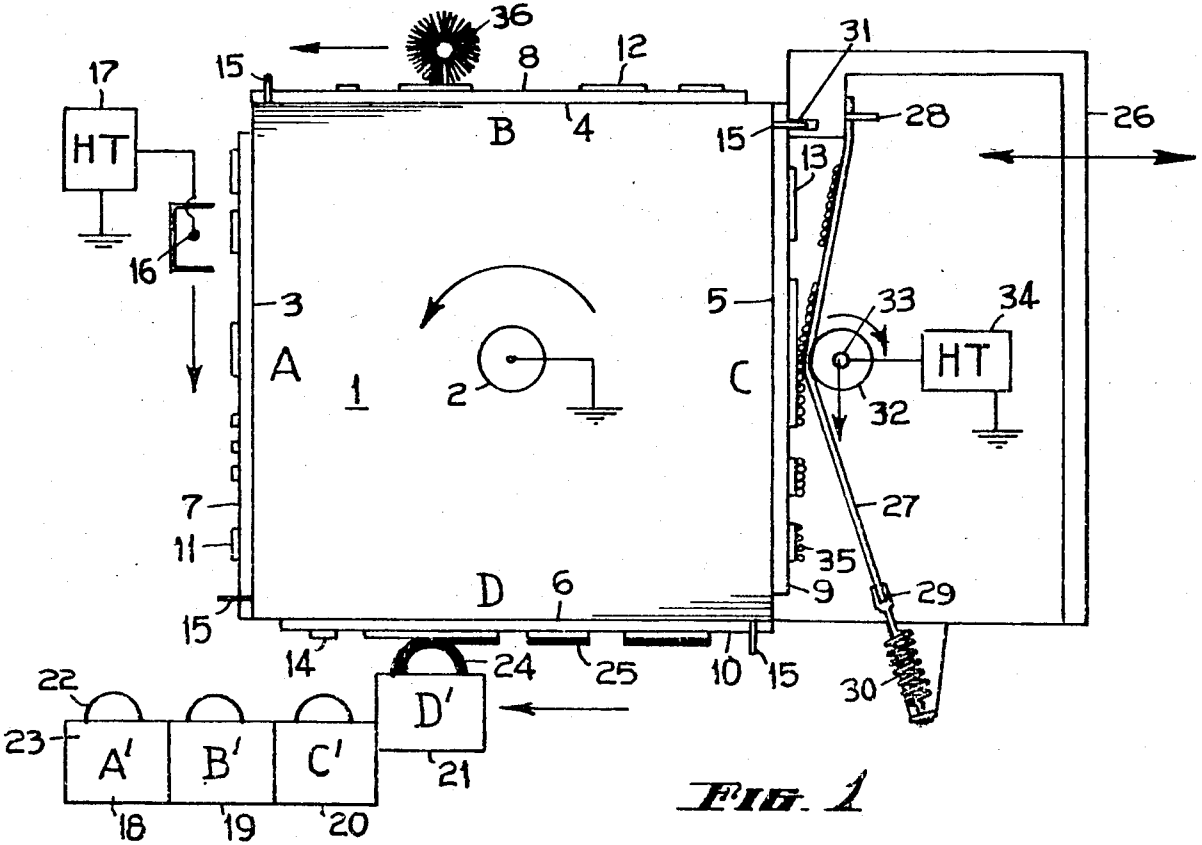

The invention will now be described in more detail with reference to the drawing where FIG. 1 is a schematic cross sectional end view of the electrostatic duplicator of this invention showing the square carrier member and the functional stations adjacent each flat side thereof.

The carrier member 1 is rotatably mounted on shaft 2 which is driven by means not shown adapted to rotate carrier member 1 by an angle of 90° in counterclockwise direction as shown by the arrow at predetermined time intervals. Carrier member 1 has four flat sides 3,4,5 and 6 respectively, which are grounded through shaft 2 as shown. Four electrostatic masters 7,8,9 and 10 containing on their surfaces primary dielectric toner deposits 11,12,13 and 14 representing four different color contents, typically yellow as the first color, cyan as the second color, magenta as the third color and black as the fourth color, designated by the letters A, B, C and D, are mounted preferably by vacuum hold and in register by means of register pins 15 onto the grounded sides 3,4,5 and 6 respectively of carrier member 1.

The charging station in the arrangement as shown is to the left of carrier member 1, the toning station is beneath it, the transfer station is to its right and the cleaning station is above it.

The charging station comprises a corona generator as is well known consisting of a shielded corona wire 16 which is connected to one terminal of high tension supply 17, the other terminal of which is grounded, as shown. Shielded corona wire 16 is adapted to traverse at a predetermined speed in vertical direction as shown by the arrow to apply electrostatic charges to primary dielectric toner deposits 11 on the surface of electrostatic master 7. The length of traversing path of shielded corona wire 16 is adapted to allow moving same a sufficient distance beyond carrier member 1 in order to clear the corners of carrier member 1 as it makes a 90° turn.

The toning station comprises four toner applicators 18,19,20 and 21, containing secondary toners of four different colors, designated by the letters A,B,C, and D, which correspond to the color content of electrostatic masters 7,8,9 and 10 containing primary toner deposits 11,12,13 and 14 thereon, designated with the same letters, respectively. Typically and as shown, each of the toner applicators may consist of a toning roller 22 which is partly immersed in a volume of toner contained in a tank 23 and which is caused to rotate by means not shown to become coated with toner and to apply same to the charged primary toner deposits. The transport mechanism for the toner applicators is adapted to move any or all toner applicators to a position providing clearance for the corners of carrier member 1 as it makes a 90° turn. Furthermore the transport mechanism is adapted by suitable sequence programming to cause the applicator for the toner of appropriate color to move into functional position for toning. As shown in FIG. 1 toner applicator 21 is in functional position and traverses as shown by the arrow in horizontal direction; secondary toner of the fourth color 24 is being applied to the primary toner deposits 14 of electrostatic master 10 to form secondary toner deposits of the fourth color 25 thereon.

The transfer station comprises a frame 26 adapted to be moved by means not shown in accordance with appropriate sequence programming in a horizontal direction as shown by the arrow towards carrier member 1 for the function of transfer and away from same to provide clearance when it makes a 90° turn, also for other purposes as will be described in the following. One end of the printing stock for one proof 27 is mounted to frame 26 by means of register pins 28 whereas the other end of proof 27 is held by a clamp 29 which is attached to frame 26 by means of tension spring 30 adapted to maintain the printing stock for proof 27 under tension whilst it is in the transfer station; the printing stock for any proof is mounted in frame 26 in this manner prior to the function of transferring thereto the first color secondary toner deposit and it remains therein in register and under tension until transfer thereto of the last color secondary toner deposit, whereupon it is removed and replaced by the printing stock for the next proof. Mounting and removal of the printing stock can be carried out conveniently when frame 26 is in the non functional position, remote from carrier member 1. In FIG. 1 frame 26 is shown in the functional position, closest to carrier member 1. Frame 26 contains locating holes 31 adapted to slide over register pins 15 as frame 26 is moved into the functional position whereby precise registration is attained between the electrostatic masters and the printing stock during the transfer of all four colors. Electrostatic transfer is effected by means of transfer roller 32 having a partially conductive elastomer coating as is well known over a conductive shaft 33 which is connected to one terminal of high tension supply 34, the second terminal of which is grounded, as shown. Roller 32 whilst pressing printing stock of proof 27 against dielectric master 9 is adapted to rotate in clockwise direction as shown by one arrow and simultaneously to move in downward direction as shown by the other arrow to thereby effect transfer of secondary toner deposits of the third color 35 from the primary toner deposits 13 contained on electrostatic master 9 to the printing stock of proof 27.

The cleaning station may comprise a soft brush or foam roller 36 for removal of toner residue from the electrostatic master after transfer. Roller 36 is adapted to be rotated by means not shown and to horizontally traverse the upper side of carrier member 1 as shown by the arrow, as well as to move past carrier member 1 or be raised thereabove to provide clearance for its corners when it makes a 90° turn. Roller 36 may be used dry or wetted with a solvent if so desired, alternatively it may be replaced by other cleaning means such as a cleaning blade made of plastic such as polyurethane or the like as is well known.

FIG. 1 illustrates a condition where the 4-color proof being processed needs two more functions for completion, and whilst these two functions are being performed simultaneously two other functions are also being performed simultaneously preparatory for the next proof. In more detail, proof 27 contains already the first (A') and second (B')color deposits—not shown —, and needs for completion transfer of the third (C')color deposits which is in process on side 5 of carrier member 1, to be followed by transfer of the fourth (D')color deposits which are in process of being deposited on side 6 of carrier member 1 in the toning station preparatory to transfer upon the next 90° turn of carrier member 1. The time saving feature of this invention consists in overlapping the functions on sides 5 and 6 of carrier member 1 for completion of one proof with functions on sides 3 and 4 of carrier member 1 for starting the next proof: electrostatic master 7 on side 3 is being charged preparatory to toning with the first (A')color for the next proof upon the next 90° turn of carrier member 1, whereas electrostatic master 8 on side 4 after transfer of the second (B')color deposits onto proof 27 is being cleaned preparatory for charging for the next proof upon the next 90° turn of carrier member 1.

Upon transfer of each color frame 26 moves away from carrier member 1 into the non functional position where the proof is dried by means not shown, such as vacuum, air stream or heat, following which it may be re-wetted with a solvent to improve transfer efficiency as is well known. Since the printing stock remains in register on frame 26 throughout the transfer of all colors, repeated drying and wetting of the paper have no effect on precise alignment of all color deposits transferred thereto.

We have found that for a 20×24 inch finished size proof the width of the flat sides of the carrier member can be about 23 inches, allowing 3 inches total over 20 inches for clearance at one end and registration at the other end of the electrostatic masters. Such square carrier member would measure 32.5 inches from corner to corner, which means that the transfer assembly, and if so constructed the toning and cleaning assemblies, would have to retract 4.75 inches from their functional positions to provide clearance for the carrier member as it takes a 90° turn. The axial depth or length of such carrier member would have to be about 25 inches allowing a total of 1 inch clearance for the 24 inch proof dimension.

We have also found that the time required to prepare a proof in accordance with this invention is largely dependent on the time required to dry the printing stock between colors. For instance we have found that a 20×24 inch proof on publication stock paper can be conveniently dried with warm air stream in 1 minute. All functions of charging, toning, transfer and cleaning require less time. Assuming therefore 1 minute per color, a 4-color proof can be produced in continuous mode of operation where multiple proofs of one and the same subject are made every 4 minutes. Such relatively short time as compared with present methods of proofing is accomplished by the overlap of functions as disclosed in the foregoing.

It will be realized that the geometry and mode of operation of the functional stations as disclosed in the foregoing can be modified or changed to suit particular requirements. For instance the roller type toner applicators can be replaced by fountain type or any other suitable type of liquid toner applicator as known in the field of document copying. The transfer station as herein described can also be replaced by one operating on other principles: the printing stock can be registered at its lower rather than upper end, the arrangement can provide for a pre-roll traverse followed by a transfer traverse as disclosed in U.S. Pat. No. 4,182,266, different printing stock tensioning means can be used, corona instead of roller transfer can be employed, the direction of transfer can be along the axis of the carrier member rather than along the width of its side as shown here, and transfer may be carried out not directly onto the printing stock as shown here but by means of an intermediate or offset member, again as disclosed in U.S. Pat. No. 4,182,266.

Furthermore it should be realized that ancillary step or means known to be useful in electrographic equipment employing liquid toners such as for instance prewetting of the charged electrostatic masters with a solvent prior to toning to reduce fog, biasing means in toner applicators to enhance image density or to reduce fog, vacuum means to remove fog forming toner from the electrostatic master after toning and/or to control the toner layer thickness or degree of wetness thereon prior to transfer, means to wet the electrostatic master after transfer and prior to cleaning with solvent to facilitate cleaning, also drying after cleaning the electrostatic master prior to charging and the like features can be employed with advantage in the electrostatic duplicator of this invention.

There has been described an electrostatic duplicator for the production of multiple prints or proofs of a 4-color or multicolor subject matter. The configurations disclosed herein are intended to only illustrate the principles of this invention without limiting its scope in any way.

I claim:

1. Apparatus for the production of multiple copies by the process of electrostatic duplication which process comprises in essence providing an electrostatic master having a surface containing relatively conductive non-image areas and dieletric image areas and a sequence comprising the functional steps of electrostatically charging such dielectric image areas, applying toner to such charged dielectric image areas to form toner deposits thereon, transferring such toner deposits to a receiving member and cleaning the surface of said electrostatic master, said apparatus comprising a rotatably mounted carried member of square cross-section and having four faces, means for affixing an electrostatic master to each of the four faces of said carrier member, an electrostatic charging station for electrostatically charging an electrostatic master affixed to a face of said carrier member, a toning station for applying toner to an electrostatic master affixed to a face of said carrier member, and comprising a plurality of toner applicator adapted to each apply a toner of a different color, and means to cause a particular one of said plurality of toner applicators to apply toner to an electrostatic master affixed to a particular one of said faces, a transfer station including means for holding a sheet means to which toner is to be transferred, and means to sequentially transfer toner from electrostatic masters affixed to at least two of said faces to the sheet means, in register, during a single rotation of said carrier member, and a cleaning station, said stations respectively, affixedly, position around said carrier member at respective faces threof in the respective order recited, each said station position for simultaneously acting on a different one of said faces, wherein the functions of charging, toning, transfer and cleaning can be carried out simultaneously, one function respective to each electrostatic master affixed to the four faces of said carrier member, and wherein electrostatic masters affixed to the four faces of said carrier member can be advanced progressively to each functional step of charging, toning, transfer and cleaning by rotation of said carrier member in one quarter turn increments.

2. Apparatus as in claim 1, wherein said transfer station includes means to transfer toner to the sheet means electrostatically.

3. Apparatus as in claim 1 wherein said means for affixing an electrostatic master comprises vacuum means.

4. Apparatus as in claim 1, wherein said transfer station includes a retractably mounted transfer assembly positioned near the respective face of the carrier member.

5. Apparatus as in claim 1 or 4, wherein said transfer station includes means for holding a sheet means in a stationary position for sequential transfer of toner.

6. Apparatus as in claim 1 or 4, wherein said toner applicators are adapted to apply yellow, magenta, cyan and black toners, and wherein said transfer station includes means for holding a sheet means in a stationary position for sequential steps of transfer.

7. Apparatus as in claim 4 wherein registration means are provided to affix electrostatic masters to said four faces of said carrier member in register with respect to each other and to said transfer assembly and wherein said transfer station holds the sheet means in stationary position for sequential steps of transfer.

8. Apparatus as in claim 4, wherein registration means are provided to affix electrostatic masters to said four faces of said carrier member in register with respect to each other end to said transfer assembly, wherein said transfer assembly is adapted to retract from said carrier member prior to such carrier member being rotated and thereafter to return to same and in register therewith and wherein said said transfer station holds the sheet means in stationary position for sequential steps of transfer.

9. Apparatus as in claim 4, wherein said transfer assembly is adapted to retract from said carrier member for a distance sufficient to allow rotation of said carrier member.

* * * * *